United States Patent [19]

Munn et al.

[11] 4,385,765

[45] May 31, 1983

[54] CONQUEST GAME

[75] Inventors: J. Knox Munn, Arvada; Thomas Roberts; Curtis L. Stocker, both of Boulder, all of Colo.

[73] Assignee: Circle Games, Boulder, Colo.

[21] Appl. No.: 236,983

[22] Filed: Feb. 23, 1981

[51] Int. Cl.[3] ..... A63F 3/00

[52] U.S. Cl. ..... 273/253; 273/255

[58] Field of Search ..... 273/253, 250, 249, 243, 273/255, 262, 251, 252

[56] References Cited

U.S. PATENT DOCUMENTS

| | | | |
|---|---|---|---|
| D. 208,258 | 8/1967 | Bingham | 273/253 X |
| 3,184,237 | 5/1965 | Riva | 273/249 X |
| 4,010,954 | 3/1977 | Uding | 273/253 |
| 4,114,891 | 9/1978 | Lawrimore | 273/250 |
| 4,211,420 | 7/1980 | Quiroz | 273/290 X |
| 4,248,437 | 2/1981 | Lemberger et al. | 273/243 |
| 4,296,928 | 10/1981 | Nick | 273/262 |

FOREIGN PATENT DOCUMENTS

| | | | |
|---|---|---|---|
| 1185823 | 8/1959 | France | 273/253 |
| 935310 | 8/1963 | United Kingdom | 273/253 |

OTHER PUBLICATIONS

Advertisement for "Clue"#, *Playthings Magazine*, May, 1959, p. 1.

*Primary Examiner*—Richard C. Pinkham

*Assistant Examiner*—Scott L. Brown

*Attorney, Agent, or Firm*—Timothy J. Martin; James R. Young

[57] ABSTRACT

A solar system conquest game has a game board including a plurality of movement paths that form a first set of concentric circular orbits and a second set of orbits intersecting the circular orbits at pre-selected locations with these orbits defining movement paths for playing pieces corresponding to each player. The intersections define exchange points where pieces may change orbits. A set of cards determines additional pieces to be entered onto the board by a player, and dice determine the number of movement steps to be traversed by a player during his turn, and a second set of dice controls the outcome of a confrontation between playing pieces. The game board may further be divided into a number of sectors, and a set of instruction cards influence events in a particular sector for all players having pieces located therein. Base points may be located on selected orbits, and pairs of jump points may also be located on selected orbits and defined by exit points and entry points whereby a player may move directly from an exit point to an entry point. Playing pieces are of two types, a unit piece and a carrier piece having a larger value than the unit piece and configured to physically receive said unit pieces for transport therewith. Additional chance cards may be provided to influence game conditions.

27 Claims, 7 Drawing Figures

CONQUEST GAME

BACKGROUND OF THE INVENTION

This invention relates to games in general, and more particularly to an astrological-astronomical conquest game designed around our own solar system. While various astronomical, and especially solar games, are known, many involve a simple chase or travel format. Further, while several of these games such as those disclosed in U.S. Pat. No. 1,538,143 issued to Muir, U.S. Pat. No. 3,223,420, issued to Turner, U.S. Pat. No. 944,631, issued to Newsome, and U.S. Pat. No. 3,099,451, issued to Newhouse, depict the basic solar system comprising the sun and the planets, none continue their depiction of the solar system beyond the orbit of Pluto. Some game boards of earlier developed games, such as the Muir patent, refer to the zodiac; however, none provide an intimate relationship of the zodiac to the solar system.

SUMMARY OF THE INVENTION

It is therefore an object of the present invention to provide a game which blends intellectual strategy with an element of chance wherein one player eliminates the remaining players' game pieces to completely dominate the game board.

It is another object of the present invention to provide a game which depicts the solar system and which includes an interrelationship of the solar system with the astrological constellations.

It is yet a further object of the invention to create an exciting, yet educational game through the interaction of orbital travel, colonization, conquest and astrological destiny.

To accomplish these objects, the preferred embodiment of the present invention includes a game board configured to include a representation of the nine planetary orbits about the sun inscribed as concentric circles about a common center. The planetary orbits are provided with base locations with the base location on each of the outer six orbits providing home bases for each respective player with the remaining base locations defining colonization points. A second set of orbits are provided with each of these orbits preferably being an ellipse inscribed about the common center and intersecting the circular orbits at pre-selected locations. Each of the orbits is comprised of movement steps so that playing pieces corresponding to each player may be moved therearound either in a circular orbit or in one of the elliptical orbits with a player being allowed to change orbits at any intersection therebetween. Movement dice are provided to determine the number of steps each player may move during his turn and command cards are provided to be drawn by a player to determine randomly the additional number of pieces to be entered by that player onto the game board after a successful attack. When two players confront one another, attack dice are provided to determine the outcome of that confrontation by the removal by each player of his playing pieces according to the roll of the dice.

The game board, in the preferred embodiment, is further enhanced by the addition of sectors which are preferably formed to correspond to the twelve zodiac signs by means of lines extending radially outwardly from the common center. Destiny cards are provided with half of the destiny cards containing instructions influencing the conditions within each of the sectors at the start of each player's turn while the remaining half of the destiny cards contain instructions pertaining specifically to the player who draws such card. Each of the sectors has a base point contained therein on one of the elliptic orbits passing through the sector with this base point representing a star. Further, pairs of transfer points are located on the elliptical orbits and are defined by an exit point and an entry point whereby a player may directly move his playing pieces from an exit point to the corresponding entry point. The exit points and entry points for each pair are on different elliptical orbits and preferably the entry point corresponds to one of the base points.

Finally, in the preferred embodiment, the playing pieces are formed of two types, a unit piece designated as a "fighter" having a unit value, and a carrier piece designated as a "star ship" having a value which is greater than the unit piece and which is configured to receive unit pieces for common movement therewith. In this manner, the star ship may transport fighters with it as it moves along the orbits.

The major objective of the game is for a player to conquer the solar system by eliminating all playing pieces corresponding to each of his opponents. A player draws a destiny card at the start of his turn which influences events in a particular sector or which influences that player's capabilities during that turn. The player then moves any group of playing pieces according to the roll of movement dice, however, unit pieces not carried in the carrier pieces must be moved in groups of five or less. The player then attacks opponent players by moving a group or force of his players directly behind a group of the opponents players and then rolling the attack dice whereby the ratio thereon determines the number of playing pieces to be removed by each player. Rolling the attack dice continues until one of the forces is eliminated. If the moving player wins the attack, that player draws a command card which awards the player additional unit pieces for entry onto the board at his home base location. The command card must be used immediately after which the player may roll the movement dice again, and the turn ends when that player is not in a position for attack or strategically chooses not to attack any opponent player pieces. Bonus playing pieces are awarded to any player who starts his turn while occupying colonization points which include all of the base points and the inner three base locations.

These and other objects, advantages and features of the present invention become more apparent as the description proceeds, taken inconjunction with the accompanying drawings, in which:

DETAILED DESCRIPTION OF THE PREFERRED EMBODIMENT

This invention relates in general to games, and more particularly to an astrological-astronomical conquest game. While it is to be appreciated from the outset that the format of this game is set forth to correspond to the solar system, the principles set forth with respect to this game can carry over to a variety of different representative game boards as long as the basic interrelationships among the movement paths for the player's pieces are maintained. Broadly, the game equipment comprises: a game board, two types of player position markers, two types of dice, and two types of player instruction cards.

Figure 1:
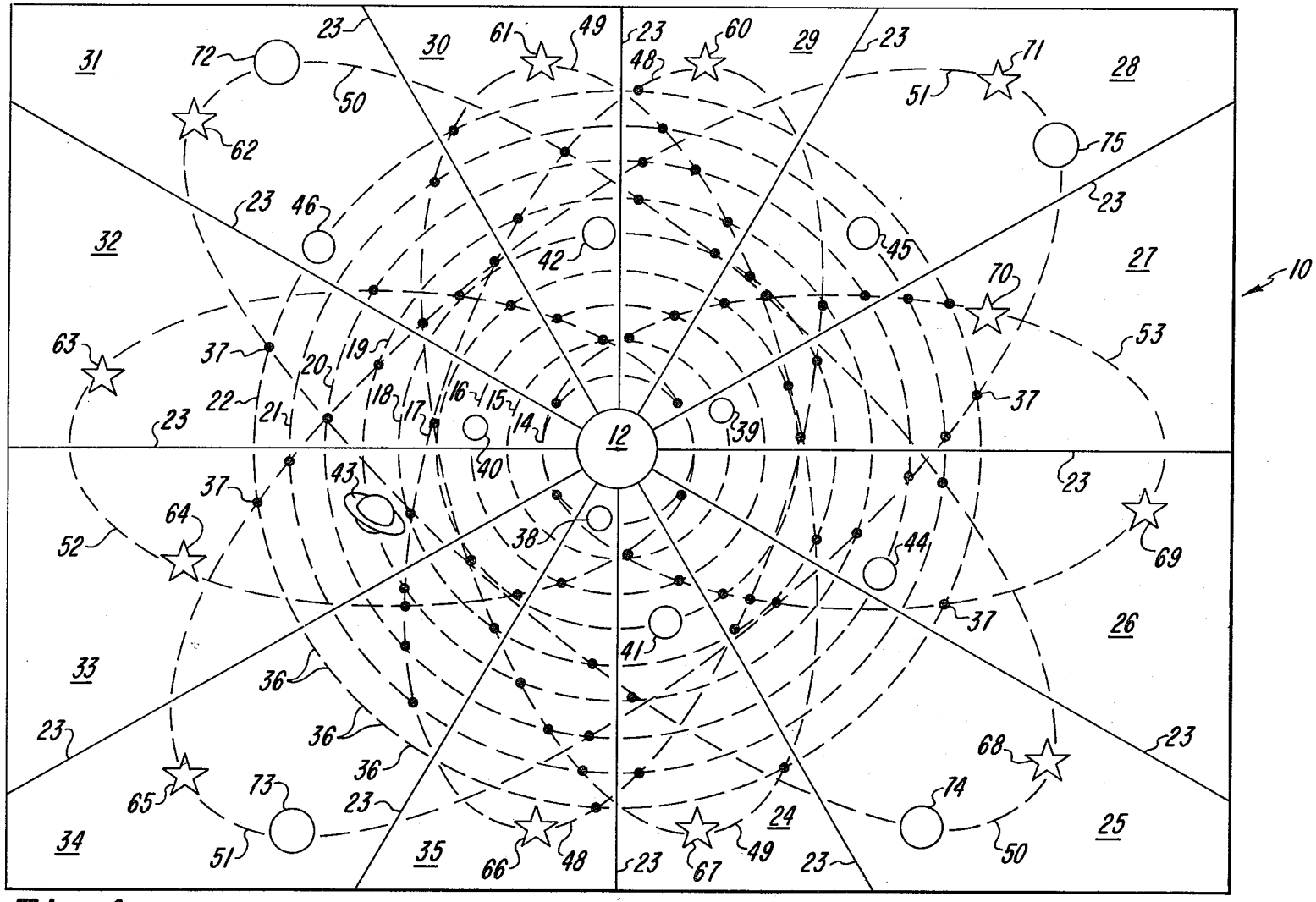
FIG. 1 is a top plan view of the game board according to the present invention.
Figure 2A:
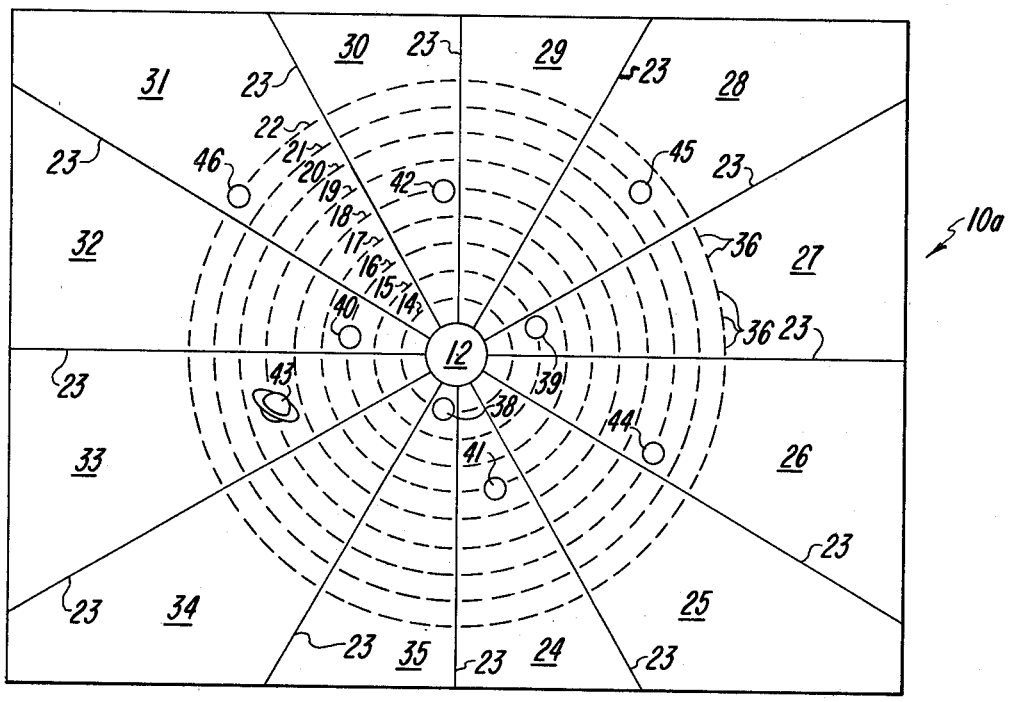
FIG. 2A represents a top plan view of that portion of the game board designated as the concentric circular planetary orbits.
Figure 2B:
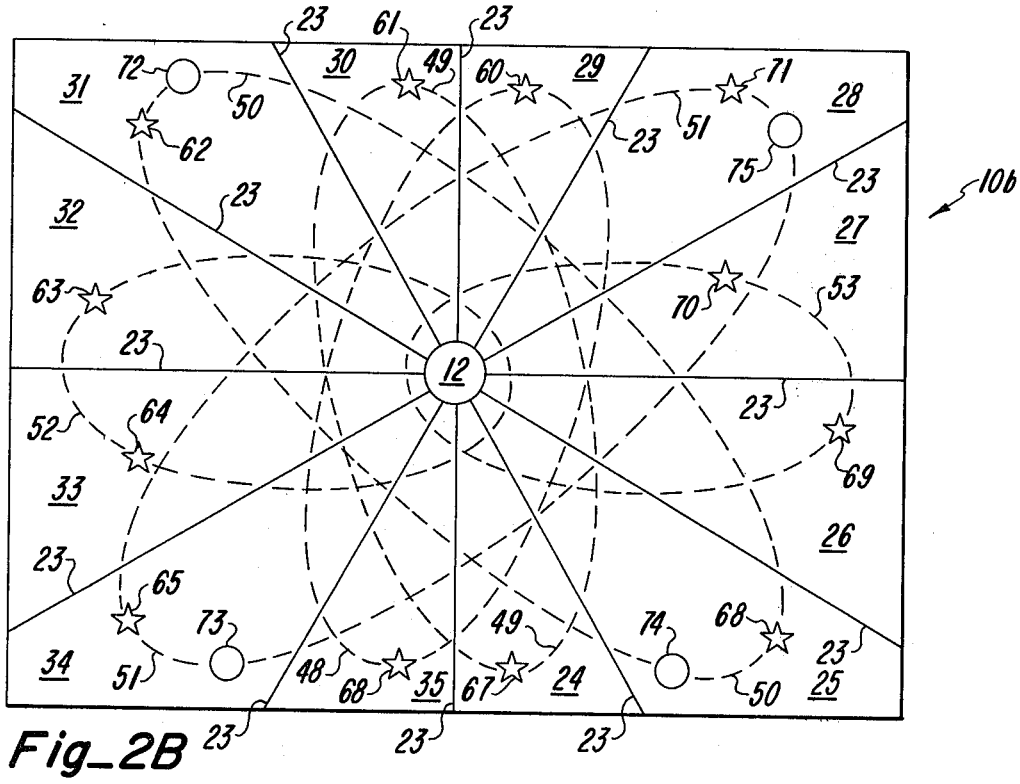
FIG. 2B is a top plan view of that portion of the game board defined by the elliptical orbits around the common center.

Specifically, game board 10 is shown complete in FIG. 1 and is comprised of the superposition of the partial depictions of the game board 10*a* and 10*b* shown respectively in FIGS. 2A and 2B. As is shown in FIG. 2A, the game board 10*a* has a rectangular configuration and is inscribed in any convenient manner with a central circular area 12 and a series of nine concentric orbits or circles 14–22 surrounding the common center 12. Twelve lines 23 radiate outwardly from circular area 12 to divide the game board 10 into twelve sectors 24–35. Each of concentric circles 14–22 are formed as a broken line to indicate movement steps, such as movement steps 36 shown with respect to circle 22. None of these steps are intersected by lines 23, and it should be appreciated with respect to FIG. 2A that circle 14 has one step in each of sectors 24–35 while circles 15 and 16 have two such movement steps in sectors 24–35. Circles 17 and 18 have three such movement steps in sectors 24–35 and circles 19, 20, and 21 have four such movement steps in each of sectors 24–35. Finally, circle 22 has five movement steps in each of sectors 24–35. Each of circles 14–22 define circular paths or orbits about the common center with this center being representative of the sun. Accordingly, each of circular orbits 14–22 represents the nine paths of the planets about the sun, and these planets are designated on game board 10 and 10*a* as colonization points 38–40 and base locations 41–46.

FIG. 2B shows partial game board 10*b* having the common elements of the circular center 12, lines 23 and sectors 24–35 as described with repect to FIG. 2A. It should be appreciated that game board 10 is formed by the superpositioning of partial game board 10*b* on partial game board 10*a*. Additional movement paths or orbits 48–53 are inscribed on board 10*b* as broken ellipses surrounding common center 12. Orbits 48–51 have common center 12 located at a central portion thereof while orbits 52 and 53 have common center 12 located at one extreme end thereof. Elliptical orbits 48–53 are provided with base points 60–71 with a single base point being located in each of sectors 24–35. Additionally, exit points 72–75 are provided and correspond to selected one of base points 60–71, as described below.

When partial game board 10*b* is superpositioned on partial game board 10*a*, the complete game board 10 is formed as is shown in FIG. 1. Intersections of elliptical orbits 48–53 with circular orbits 14–22 thus occur, and are indicated on game board 10 by a plurality of solid dots, such as dots 37. These intersections occur at preselected locations along movement steps for each orbit, and players may change orbits, if desired, when encountering an intersection.

As may be noted with reference to FIG. 1, the broken lines forming concentric circular orbits 14–22 and elliptical orbits 48–53 intersect at a variety of locations. As discussed below in more detail, each player has playing pieces which are confined for movement in a counter-clockwise direction around a common center 12 and are constrained to move in a specific orbital until a intersection point is reached. At an intersection, the player may elect to move in a counter-clockwise direction along any such intersecting orbital.

Each exit point 72–75 corresponds to an entry point which, in the preferred embodiment is also a base point which is designated as a "star". For example, exit point 72 corresponds to base point 66, exit point 73 corresponds to base point 60, exit point 74 corresponds to base point 61 and exit point 75 corresponds to base point 63. These respective pairs form pairs of jump points allowing a player to directly move from a respective exit points 72–75 to its corresponding base point in a single move without the necessity of moving in a complete orbital path thereto.

Figure 3:
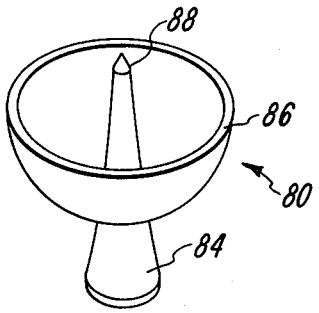
FIG. 3 is a perspective view of a representative carrier piece according to the preferred embodiment of the present invention.
Figure 4:
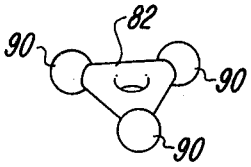
FIG. 4 is a persepective view of a unit piece.

FIGS. 3 and 4 show perspective views of representative playing pieces for the preferred embodiment of this game, although it should be appreciated that any suitable configuration of the playing pieces may be used. It is important, however, that carrier piece 80 shown in FIG. 3 be able to transport physically a plurality of unit pieces 82 shown in FIG. 4. To this end, carrier piece 80 includes an upright stand 84 which supports an upwardly turned hemispherical shell 86 with support post 84 extending through shell 86 to terminate in an upwardly positioned gripping nub 88 which facilitates movement of carrier piece 80. Unit piece 82 is a single value piece of any convenient configuration, although in the preferred embodiment it is shown as a generally triangularly shaped piece having rounded ends 90 at each vertex of the triangle. Carrier piece 80 is designated as a "star ship" and should be constructed to receive approximately forty unitary pieces 82 designated as a "fighter". A carrier piece 80 has a value which is larger than unit piece 82, for example, in the preferred embodiment carrier piece 80 has a value fifteen times that of unit piece 82.

Figure 5:
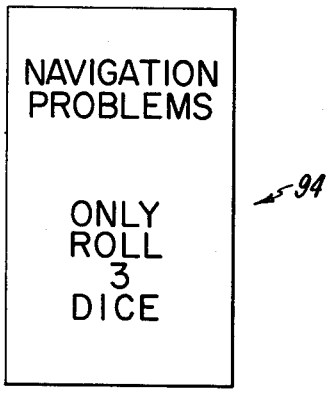
FIG. 5 is illustrative of one type of chance card employed, namely the "destiny" card.

FIG. 5 is a representative sample of an instruction card, namely, destiny card 94. Each destiny card 94 contains an instruction controlling or influencing events either specifically directed at the player who draws such a destiny card or which effect conditions for all players in a specific sector 24–35. By way of example only, the preferred embodiment of the present invention has a set of destiny cards having forty-eight individual cards, 24 of which relate to the player's roll of the movement dice discussed below. Destiny card 94, for example, reduces the number of dice which the player may roll. Twelve of the destiny cards influence conditions to create positive effects in a selected one of sectors 24–35, for example, by increasing the number of playing pieces for each player having pieces in that sector. Twelve destiny cards 94 relate to negative events and thus negatively influence conditions on corresponding sector 24–35, such as, the removal of all playing pieces in that sector.

Figure 6:
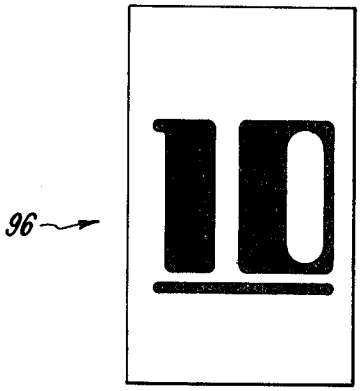
FIG. 6 is an illustration of a second type of card employed, namely the "command" card.

FIG. 6 shows a representative command card 96, with the set of command cards comprising forty-eight command cards having values thereon from one to ten. A command card is drawn by a player after a successful attack on an opponent's pieces and must be used immediately. The value of the command card awards the player additional unit pieces corresponding to the number on the command card and, when the command cards are turned in, these pieces are entered onto the game board in the manner described below.

Figure 7:
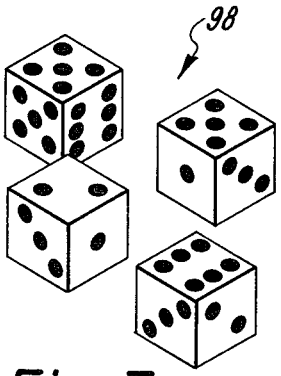
FIG. 7 is illustrative of the roll of "movement" dice.

It is an objective for each player in the game to attempt to eliminate all of his opponents, and the winner of the game is, accordingly, the last player to remain. The removal of opposing player pieces is accomplished by means of movement dice 98, shown in FIG. 7 and attack dice 100 shown in FIG. 8. While it should be appreciated that movement dice 98 and a set of attack dice 100 are preferred for this invention, any suitable chance means known in the art may be utilized both to move the player's pieces and to determine the outcome of an attack.

Figure 8:
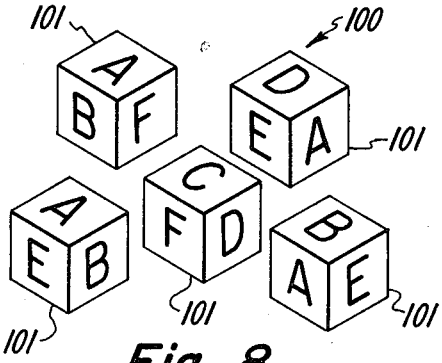
FIG. 8 is illustrative of the roll of "attack" dice.

By way of example, then, a player moves groups of his pieces according to the values rolled by casting dice 98 along the movement steps of orbits 14–22 and 48–58 with each dash or movement steps such as movement step 36, having a unit value. A player having the roll shown in FIG. 8 would be entitled to move 17 steps. An attack is effected by the movement of the moving player's forces or groups of playing pieces behind and adjacent an opposing player's piece or group of playing pieces. One such a juxtaposition occurs, the moving player rolls the attack dice until either his own group of playing pieces is eliminated from the board or until the opposing player's playing pieces are removed from the board. Accordingly, attack dice 100 must determine a ratio of relative losses for each player to determine how many unit pieces 82 that the attacking player and the defending player must each remove from the board. In the preferred embodiment of the present invention, a set of attack dice 100 having individual die members 101 are each cubic with one side color coded to correspond to each of the six colors used for playing pieces 80 and 82. In FIG. 8, these colors are labeled as letters A-F for representation purposes. When dice 100 are cast, only the exposed colors corresponding to the attacking player and the defending player have any effect. For example, FIG. 8 shows the cast of dice 100 for an attack by player A on player B. Since two exposed or upturned faces of dice 100 have an "A" color and one of the dice 100 has an exposed "B" color, player A would be required to remove two unit playing pieces and player B would be required to remove one playing piece. Players C-F would not be affected. Of course, any suitable means for determining relative removal of pieces is within the scope of this invention.

While it should be appreciated, from the above discussion, that any interrelated pattern and shape of movement paths may be utilized without departing from the scope of this invention, the game board as described above represents the solar system. Specifically, the common center 12 represents the sun while colonization points 38–40 represent the planets Mercury, Venus and Earth. Base locations 41–46 respectively represent the planets Mars, Jupiter, Saturn, Uranus, Neptune and Pluto. Concentric circles 14–22 thus represent the orbit of these planets about the sun. The sectors 24–35 correspond to each of the twelve astrological or zodiac signs such that the destiny cards 94 which relate to events within each sector thus correspond to positive and negative astrological fates, hence introducing an element of astrological fate to the astonomical configuration of the planet orbitals. Base points 60–71 correspond to stars or star regions with elliptical orbits 48–53 corresponding to interstellar travel paths between the sun and the stars. Exit points 72–75 represent black holes whereby player's pieces may exit the board and enter through a corresponding star or base point 60–71 as set forth above. However, to complete the understanding of the preferred embodiment of this conquest game, it is helpful to have a further understanding of the relationships of the various game components.

Specifically, the preferred embodiment of the present invention is designed for use by two to six players A-F, as discussed above, who arbitrarily decide the order of turns to be taken. Each player begins the game with a specified number of fighters and one star ship. Preferably orbits 17–22 are color coded to correspond to colored playing pieces representing each distinct player. Prior to the start of the game, it is preferred that each player have twenty-five fighters and one starship which has a value of fifteen fighters. These pieces are then placed anywhere on a player's color coded home orbit 17–22. The deck of command cards 96 and the deck of destiny cards 94 are each shuffled and conveniently placed anywhere on the board, and the destiny card deck is cut in half so that, when half of the deck is used the entire deck is reshuffled.

At the start of each player's turn, the respective player draws a destiny card which is immediately revealed and the resultant instruction followed which may affect all or none of the players. Any additions or removal or movement of pieces, forming playing forces, takes place immediately according to the destiny card. If the destiny card indicates that a specific event cause two or more players occupy a common space, the player who drew the card occupies that space and the next player occupies the next empty space ahead of the first player and so on for the other players.

After the instructions of the destiny card have been followed, the first player rolls the movement dice 98. Normally four such dice are rolled, however, a destiny card may require a player roll less than the complete set of movement dice. Playing pieces are moved as groups or forces and the fighters must move in groups of five or less unless accompanied by a starship which may contain or carry as many fighters as it can hold. Thus, a large force must be moved by a starship. Only one force may be moved at a time and all movement must be in a counter-clockwise direction around the center 12 up to the amount of steps indicated by the throw of the dice. While moving, a player may jump his own forces or playing pieces, but no opposing forces may be jumped by a player.

If, upon movement of his pieces, a player confronts an opposing player's pieces by moving his force adjacent the opponent's pieces, the player may elect to attack those forces. Attack is accomplished by means of rolling the attack dice 100 which yields a ratio which requires that each player remove a corresponding number of pieces from the attacking and defending groups. For example, as described above, the attack dice may be color coded, so that the attacking player must remove a number of fighters corresponding to the number of upturned faces corresponding to his color after rolling the attack dice and the defending player must remove the number of fighters corresponding to the number of upturned faces corresponding to his color. For those players who are neither attacking nor defending, there is no effect if their color lies face up after casting the attack dice.

If the defender successfully defends by defeating the attacking force, the attacking player's turn ends. If the attacking player eliminates the defending player's forces, the attacking player draws a command card and is awarded additional fighters corresponding to the value thereon. These fighters must be brought into the game immediately on the player's home planet in the home orbital 17–22. If the player elects to continue his turn, another destiny card is drawn, and, after its instructions are followed, the player then rolls the movement dice again and play proceeds as before. The turn ends when a player is not in a position for attack or chooses not to continue his turn; the next player then begins his turn.

Additional rules govern the turn, as follows. The attacking position must be immediately adjacent an opponents force in a space immediately behind that force and this positioning may be accomplished through destiny cards, an opponent's movements, or a player's movements by way of the movement dice. No force may be attacked in its home orbit except at an intersection unless that player's forces are found only in its home orbit. An attack must continue until the defender or the attacker wins once an attack is declared. Upon completion of the attack, the attacking force occupies the space formerly held by the defender. During movement, any number of fighters may be picked up or left off on any given orbital movement as long as the rule regarding the starships is followed. The use of the pairs of jump points comprising exit points 72–75 and their corresponding base points permit "instantaneous leaps" from the exit point to its corresponding base point. Exit points 72–75 are designated as "black holes" and four are present in the preferred embodiment of the present invention. A player may decide to pass over a black hole or enter it, but the player may not stop on it except to attack. If a player enters a black hole, the forces thereon are transported to the indicated entry point which is a corresponding star and forms one of the base points 60–71. Upon such transportation, the player may either continue with the remainder of the roll or stop. Also, when passing over a black hole, it is permissible for the player to dispatch any portion of the force to the indicated star. If the designated entry point or star is occupied however by an opposing force, the transported force must attack immediately.

Additional fighters are awarded at the start of a turn for colonization of the stars base points 60–71 or base locations 41–46 or colonizations points 38–40 according to an arbitrary value assigned thereto. These additional fighters are assigned at the start of the player's turn if that player presently occupies those positions and must be brought immediately onto the game on the player's home planet. The additional fighters awarded for colonization, as well as fighters awarded by command cards, cannot be entered onto the board and are thus forfeited if that player's home planet is occupied by an opponent.

Although the present invention has been described with a certain degree of particularity, it is understood that the present disclosure has been made by way of example and that changes in details of the structure may be made without departing from the spirit thereof.

We claim:

1. A conquest game comprising:

a game board having a first set of concentric circular orbits inscribed about a common center, a second set of orbits inscribed about said center and intersecting said circular orbits at pre-selected locations, each of said orbits comprising a plurality of discreet movement steps, each of said pre-selected locations corresponding to a discreet movement step of each respective intersecting orbit, said game board having a plurality of lines which divide the game board into a plurality of sectors containing movement steps and having base locations corresponding to each player and associated with selected ones of said orbits;

a plurality of differently identified playing pieces corresponding to each player and adapted for movement along said orbits;

first chance means for determining the number of playing pieces to be entered onto the game board by a player;

second chance means for determining the number of movement steps to be traversed by a player's playing pieces during such player's turn; and attack means for determining removal of opposing forces of playing pieces from said game board corresponding to an attacking player and a defending player.

2. A conquest game according to claim 1 including chance event means correlated to one of said sectors for influencing conditions in at least one of said sectors at the start of a player's turn.

3. A conquest game according to claim 2 wherein each orbit of said second set of orbits has a base point.

4. A conquest game according to claim 3 wherein a portion of at least one orbit of said second set extends into each said sector and having a single base point in each sector.

5. A conquest game according to claim 2 wherein said sectors are formed by lines extending radially outwardly from said common center and spaced equiangularly therearound.

6. A conquest game according to claim 5 having nine circular orbits and having one of said base locations located on each of the outer six of said circular orbits in different ones of said sectors.

7. A conquest game according claim 2 wherein said chance event means being a set of destiny cards, one half of said destiny cards being instruction cards affecting all players in one of said sectors and the remaining half of said destiny cards affecting movement of the playing pieces of the player drawing the destiny card.

8. A conquest game according to claim 1 wherein said second set of orbits are elliptical in configuration.

9. A conquest game according to claim 8, said conquest game being a solar system conquest game wherein there are nine circular orbits representing planetary orbits, said common center representing the Sun, and having six of said elliptical orbits.

10. A conquest game according to claim 9 wherein said game board is divided into twelve sectors by lines extending radially outwardly from said common center and spaced equiangularly therearound, each said sector representative of one of the twelve zodiac signs and including chance event means having indicia correlated to said sectors for influencing conditions in at least one of said sectors during a player's turn.

11. A conquest game according to claim 10 wherein said base locations are configured to represent planets and are located each in a different one of said sectors.

12. A conquest game according to claim 1, said game board having pairs of jump points located on movement steps and indexed to one another, said jump points defined by an exit point and an entry point, each said exit point located on one orbit and its associated entry point located on another orbit, said playing pieces directly movable from an exit point to its associated entry point as a single movement step.

13. A conquest game according to claim 12 wherein said pairs of jump points being located on selected orbits of the second set of orbits.

14. A conquest game according to claim 13 wherein each orbit of said second set of orbits has at least one base point, selected ones of said base points defining said entry points.

15. A conquest game according to claim 1 wherein said playing pieces are defined for each player by a unit piece and a carrier piece having a larger value than said unit piece and configured to physically receive a plurality of said unit pieces for common movement as a group force having a multiple value corresponding to the summed value of all pieces in the group.

16. A conquest game according to claim 1 wherein said first chance means is a set of cards having individual cards of various values indexed to the unit pieces and adapted to determine the number of unit pieces to be entered onto the game board.

17. A conquest game according to claim 1 wherein said second chance means includes numbered movement dice.

18. A conquest game according to claim 1 wherein said attack means includes attack dice marked in a manner whereby a roll thereof defines a ratio determining the number of playing pieces to be removed by the attacking player and the defending player.

19. A conquest game according to claim 18 wherein said attack dice are cubic and each have a face color coded to a respective player.

20. A solar system conquest game, comprising:

a game board having nine concentric circular planetary orbits surrounding a circular center area representing the Sun, a set of interstellar orbits surrounding the Sun and intersecting the planetary orbits, each of said orbits being composed of movement steps, the intersection of said interstellar orbits with said planetary orbits occurring on selected ones of said movement steps, said game board divided into twelve sectors by lines radiating outwardly from the Sun to the edge of the game board and representing the twelve signs of the zodiac and having a base location on each planetary orbit, each said base location located in a different one of said sectors with a preselected number of said base locations being home bases corresponding to a respective player;

a plurality of first playing pieces corresponding to each player having a first value;

a plurality of second playing pieces corresponding to each player having a second value greater than said first value, said second playing pieces configured to receive a plurality of said first playing pieces for common movement therewith;

first chance means for determining the number of movement steps available to be traversed by the player's playing pieces;

second chance means for influencing one of the conditions affecting a player's ability for movement and the conditions within one of said sectors;

third chance means for awarding additional playing pieces to a player; and attack means for determining removal of playing pieces corresponding to an attacking player and a defending player.

21. A solar system conquest game according to claim 20 wherein said interstellar orbits being elliptical in configuration and having a base point in each said sector on an interstellar orbit passing therethrough.

22. A solar system conquest game according to claim 21 wherein said base locations and said base points represent colonization areas whereby bonuses may be awarded players occupying said colonization areas.

23. A solar system conquest game according to claim 21 wherein said set of insterstellar orbits include pairs of jump point indexed to one another and defined by an exit point and an entry point each being a single movement step whereby a player may move playing pieces directly from an exit point to its respective entry point as a single movement step, each said entry point being one of said base points.

24. A solar system conquest game according to claim 20 wherein said first chance means includes dice and said second chance means being a deck of fate cards wherein half of the cards affect a player drawing a card and the other half of the cards are indexed with instructions for affecting events for all players having playing pieces in a selected one of said sectors.

25. A solar system conquest game according to claim 20 wherein said attack means includes cubic dice each having a face color coded to a respective player.

26. A solar system conquest game according to claim 20 wherein said third chance means including a deck of command cards indexed with an integer.

27. A solar system conquest game according to claim 20 wherein six of said planetary orbits are color coded to a respective player and said first and second playing pieces being color coded to a respective player.

* * * * *